US005319713A

United States Patent [19]

Waller, Jr. et al.

[11] Patent Number: 5,319,713

[45] Date of Patent: Jun. 7, 1994

[54] MULTI DIMENSIONAL SOUND CIRCUIT

[75] Inventors: James K. Waller, Jr., Lake Orion, Mich.; Derek F. Bowers, Sunnyvale, Calif.

[73] Assignee: Rocktron Corporation, Rochester Hills, Mich.

[21] Appl. No.: 975,612

[22] Filed: Nov. 12, 1992

[51] Int. Cl.[5] ..... H04S 3/00

[52] U.S. Cl. ..... 381/22

[58] Field of Search ..... 381/18, 19, 20, 21, 381/22, 23

[56] References Cited

U.S. PATENT DOCUMENTS

| | | | |
|---|---|---|---|
| 3,632,886 | 1/1972 | Scheiber . | |
| 4,414,430 | 11/1983 | Gerzon | 381/22 |
| 4,589,129 | 5/1986 | Blackmer | 381/21 |
| 4,680,796 | 7/1987 | Blackmer | 381/23 |
| 4,932,059 | 6/1990 | Fosgate | 381/22 |
| 4,941,177 | 7/1990 | Mandell et al. | 381/22 |
| 5,067,157 | 11/1991 | Ishida et al. | 381/13 |
| 5,216,718 | 6/1993 | Fukuda | 381/18 |
| 5,251,260 | 10/1993 | Gates | 381/18 |
| 5,263,087 | 11/1993 | Fosgate | 381/22 |

*Primary Examiner*—Forester W. Isen

*Attorney, Agent, or Firm*—Catalano, Zingerman & McKay

[57] ABSTRACT

An audio sound system decodes from non-encoded two-channel stereo into at least four channel sound. The rear channel information is derived by taking a difference of left minus right and dividing that difference into a plurality of bands. In a simplistic implementation, at least one band is dynamically steered while the other band is unaltered so as to avoid any perceived pumping effects while providing transient information to left/-right, as well as directional enhancement. In a preferred embodiment, multiple bands are dynamically steered left or right, so as to enhance directional information to the rear of the listener. In both schemes, the low pass filtered output of the sum of the left and right inputs is also combined with the directionally enhanced information, so as to provide a composite left rear and right rear output. Furthermore, the center channel information does not necessarily require a discrete loudspeaker, and can be divided so that low frequency information can be applied to the rear channels while mid and high frequency information from the center channel can be applied to the front left and right channels to compensate for any perceived loss of center information.

108 Claims, 8 Drawing Sheets

MULTI DIMENSIONAL SOUND CIRCUIT

BACKGROUND OF THE INVENTION

The present invention relates generally to audio sound systems and more specifically concerns audio sound systems which decode from two-channel stereo into at least four channel sound, commonly referred to as "surround" sound.

Surround systems generally encode four discrete channel signals into a stereo signal which can be decoded through a matrix scheme into the discrete four channel signals. These four decoded signals are then played back through loudspeakers configured around the listener as front, left, right and rear. This principle was adopted originally by Peter Scheiber in U.S. Pat. No. 3,632,886 specifically for audio applications, and the method of encoding four discrete signals into two and then decoding back into four at playback has become commonly known as "quadraphonic" sound. Scheiber's original surround system produces only limited separation between adjacent channels and therefore requires additional dynamic steering to enhance directional information. The basic principle has been applied very successfully in cinematic applications, configured in front-left, front-center, front-right and rear surround, commonly known as Dolby Stereo TM. The front-center speaker is designed to be positioned behind the movie screen for the purpose of localizing dialogue specifically from the movie screen. The front-left and front-right channels provide effects, while the rear or surround channel provides both ambient information as well as sound effects. The Dolby Pro Logic TM system, a Dolby Stereo TM system adapted for home use, uses a tremendous amount of dynamic steering to further enhance channel separation, and is very effective in localizing signals at any of the four channels as an independent signal. The Dolby system, however, provides limited channel separation with composite simultaneous signals.

Although highly effective for audio/video applications, the Dolby Pro Logic TM system is not the most desirable for exclusive audio applications. The rear surround channel is limited to 7 KHz, and it does not provide an acceptable amount of low frequency information. The mono center channel, while perfectly suited for dialogue in theater applications, is not desirable for exclusive audio. The center channel has the effect of producing a very mono front image.

It is desirable to provide a multi-channel scheme which can produce four directional channels of information designed specifically for high quality audio applications. It is also desirable that the system have the capability to generate its four directional signals directly from a standard two-channel stereo recording, therefore eliminating any requirement for encoding.

One of the most desirable applications for a system such as this would be automotive sound, configured as left/right front, and left/right rear. Current automotive audio systems send the same left/right information to the rear as is fed to the front. This produces a psychoacoustic illusion of four channel sound due to the fact that the human ear has a different frequency response to signals directed from the front than it has to signals directed from the rear. For this reason, the current four-speaker stereo system used in automotive applications sounds much more desirable than attempting to adapt a current surround system, such as Dolby's Pro Logic TM, to automotive applications. Furthermore, there are some major drawbacks to adapting a system such as Dolby's. Since only difference information would be fed to the rear speakers, the rear channel would have a bandwidth of only 7 KHz, and it would be mono in that there would be no directional information perceived to the rear of the listener. As a result, in comparing adapted Dolby Pro Logic TM with conventional four-speaker stereo, many listeners would prefer the sound imaging of the conventional four-speaker stereo system.

The majority of the steering schemes devised to enhance directional information have been designed to enhance the normal left, right, center and surround information in a similar fashion to the Dolby Pro Logic TM system. For example, using a scheme such as that disclosed by Peter Scheiber, to further enhance directional imaging from a signal previously encoded, David E. Blackmer, in U.S. Pat. No. 4,589,129, provides a discrete rear left, right and center surround channel system. This system is further enhanced for encoding aspects in U.S. Pat. No. 4,680,796 which was also devised specifically for video applications. In U.S. Pat. No. 4,589,129, a very elaborate compression/expansion scheme for encode and decode is disclosed for the purpose of providing noise reduction. However, a major drawback is encountered in this scheme in that the directional steering process is performed broadband and, in the event that predominant steering information is present, objectionable pumping effects are perceived by the listener. This system also has little serious impact in high quality audio applications, due to the fact that the left and right surround information is processed through comb filters. Should a signal be processed by the left or right surround channels, where the fundamental frequency of that signal falls into the notch of one of these comb filters, it would reduce any impact of that signal appearing at the left or right output. Morever, the comb filters will destroy any possibility for side imaging from a system in which a common signal appears at the front and rear of either side, as the rear signal will no longer have the same phase characteristics as the front signal. In addition, if the comb filter is generated with time delays, it would not have the same time domain aspects.

An additional drawback to this system is that it does not lend itself to automotive applications because the surround information is generated strictly by the difference from left and right and there is typically no low frequency energy present in the difference information signal. In automotive sound systems, the majority of the bass is derived from the rear channels because the rear speakers are typically larger and the acoustic cavity in which the speakers are enclosed can typically be much larger and thus provide better bass response.

With the success of Dolby Pro Logic TM, which has become a standard feature on commercial audio/video receivers, many manufacturers have attempted to provide additional surround schemes that can be specifically applied to audio. In particular, these schemes have added artificial delays and/or ambient information to the rear of the listener. More sophisticated and elaborate systems have been devised and implemented in which the signal is processed through DSP or Digital Signal Processing. Virtually all the attempts made in DSP have also included the addition of artificial reverberation and/or discrete delays to the rear speakers.

The addition of information not present in the source signal is not desirable, as the music that is then perceived no longer accurately reflects its original intended sound.

While DSP holds much promise for the future, it is a very expensive system by today's standard and it is desirable to provide a system that could be integrated, incorporating the advantages disclosed, for perhaps one-tenth of the cost of such a system implemented in DSP.

In light of the prior art, and the drawbacks of attempting to adapt any of the prior art systems specifically to automotive applications, it is a primary object of the present invention to provide four-channel sound which greatly enhances the conventional four-speaker stereo system commonly used in auto sound systems. It is also an object of the present invention to achieve a system that requires decode-only for use in high quality audio sound systems which receives an input from a conventional stereo signal, thus allowing for compatibility with all stereo recorded material, and decodes from this two-channel stereo signal an audio sound system incorporating at least four speakers located left/right front and left/right rear. In particular, it is desirable to be able to improve the ambient perceived to the rear of the listener. It is also an object to provide rear directional information without the necessity of adding any artificial information such as delays, reverb, phase correction or harmonics generation that is not already present in the original source material. It is also desirable to provide steering aspects to further enhance left/right directional imaging to the rear of the listener without encountering the objectionable pumping perceived with a single-band system. Furthermore, it is an object to provide emphasis to one side for directional enhancement while providing an increased amount of de-emphasis to the other side. It is also an object to provide discrete left/right imaging to the rear without the necessity of providing comb filters disposed at the audio path, due to the fact that comb filters do not provide results considered to be musically pleasing in high quality audio applications. It is another object of the invention to provide the possibility of localizing simultaneous images to the rear speakers, i.e. a given signal can be perceived as coming from the left while another signal is simultaneously coming from the right. Another object of the present invention is to provide sufficient bass information to the rear speakers of the auto sound system since the majority of the bass delivered in automotive sound is generated from the rear. A further object of the invention is to define a system that can also lend itself to future DSP applications that can further enhance the basic concept of the present invention.

SUMMARY OF THE INVENTION

In accordance with the invention, an audio sound System decodes from non-encoded two-channel stereo into at least four channel sound. The rear channel information is derived by taking a difference of left minus right and dividing that difference into a plurality of bands. In a simplistic implementation, at least one band is dynamically steered while the other band is unaltered so as to avoid any perceived pumping effects while providing transient information to left/right, as well as directional enhancement. In a preferred embodiment, multiple bands are dynamically steered left or right, so as to enhance directional information to the rear of the listener. In both schemes, the low pass filtered output of the sum of the left and right inputs is also combined with the directionally enhanced information, so as to provide a composite left rear and right rear output.

In virtually all of the prior art surround systems, center channel information, which is derived as a left plus right signal from the decoding matrix, is applied as a separate and discrete channel. This results in a perceived loss of center information because center information is distributed equally to all four channels in a conventional four-speaker system. In a preferred embodiment of the present invention, this center channel information does not necessarily require a discrete loudspeaker, and can be divided so that low frequency information can be applied to the rear channels while mid and high frequency information from the center channel can be applied to the front left and right channels to compensate for a perceived loss of center information.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
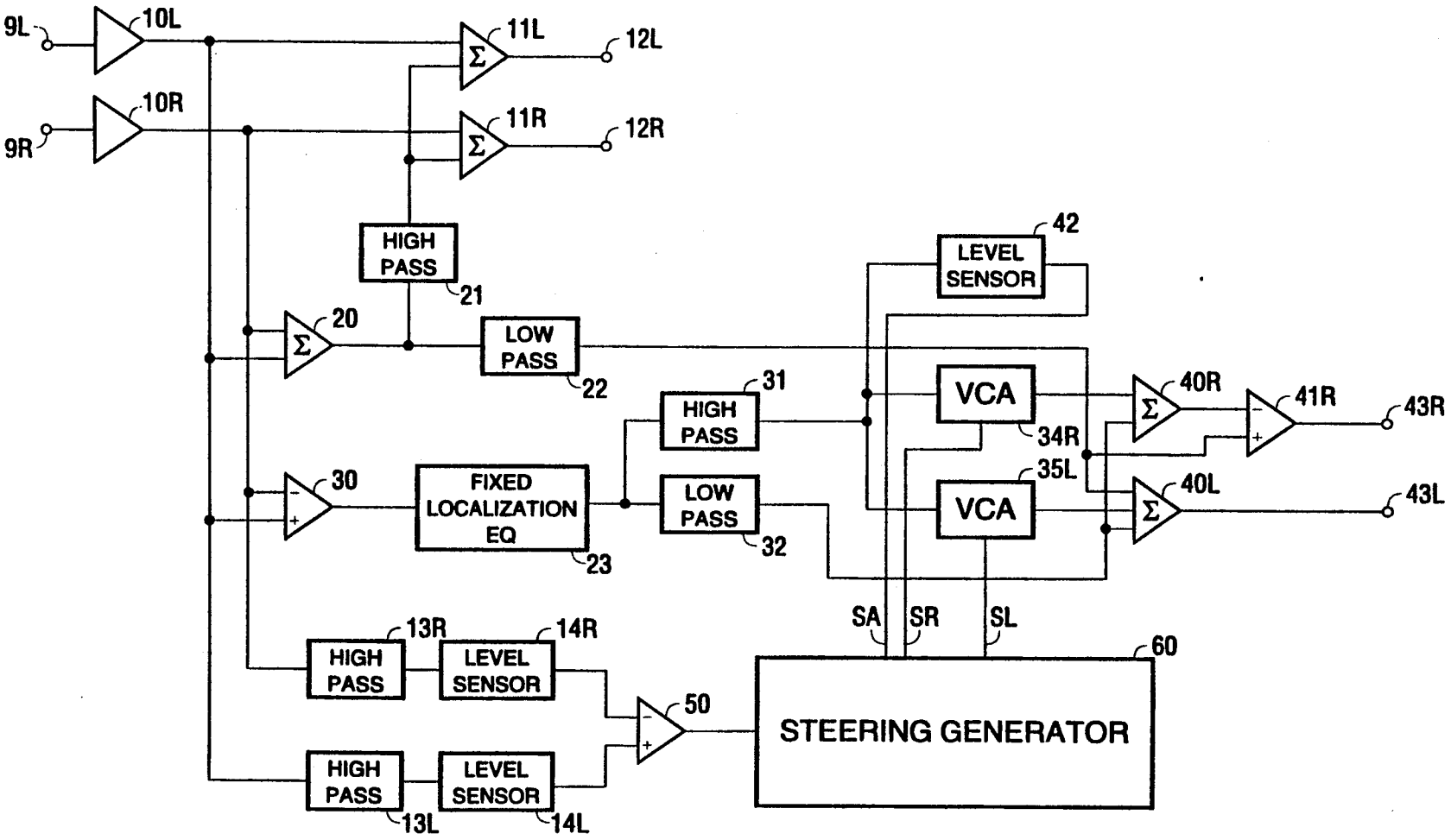
FIG. 1 is a partial block/partial schematic diagram of a simplistic implementation of the invention.

Referring first to FIG. 1, normal left/right stereo information is applied to the left/right inputs 9L and 9R. The left and right input signals are buffered by buffer amplifiers 10L and 10R, providing a buffered signal to drive the rest of the circuitry. These buffered outputs are applied directly to summing amplifiers 11 and 11R which feed the majority of the composite signal t the front left and right outputs 12L and 12R. The outputs from the buffer amplifiers 10L and 10R are also fed to a summing amplifier 20 which sums the left-and-right signals to provide an output which is further processed by a high pass filter 21 and fed to the summing amplifiers 11L and 11R which provide the additional information for the front left and right channels. The addition of the sum filtered signal is helpful in automotive applications to compensate for the decrease in center channel information due to the fact that primarily difference information is fed to the rear channels, although adding the sum filtered signal may not be necessary in some applications. It may even be desirable to feed unaltered left/right signal information to the front channels.

The outputs from input buffers 10L and 10R are also applied to a differential amplifier 30, which provides the difference between the left and right signals at its output. The left and right buffered outputs of amplifiers 10L and 10R are also applied to high pass filters 13L and 13R, respectively, for removing the bass content from the buffered left and right input signals. This is preferred so that any steering information is derived strictly from mid band and high band information present in the left and right signals.

The outputs of the high pass filters 13L and 13R are then fed to level sensors 14L and 14R, respectively, which, preferably, provide the log of the absolute value of the filtered outputs from the sensors 13L and 13R, and provide substantially a DC signal at the outputs of the sensors 14L and 14R. The DC outputs from the sensors 14L and 14R are applied to a a difference amplifier 50. The output of the difference amplifier 50 will be substantially proportional to the logarithm of the ratio of the amplitudes of the mid and high band information of the left and right signals. Other level sensing methods, such as peak or averaging, are known and can be used in place of that which is disclosed, although perhaps with less than optimal results. With a dominant energy level in the left band, the output of the differential amplifier 50 will be positive. With a dominant energy level in the right band, the output of differential amplifier 50 will be negative. The level sensors 14R and 14L have been set up with a relatively fast time constant, so as to provide very accurate instantaneous left/right steering information at the output of the difference amplifier 50. A more moderate time constant is applied in the steering generator 60 and will be discussed in greater detail in relating to FIG. 2. The output signal from the differential amplifier 50 is applied to the steering signal generator 60, which then decodes from this difference signal the DC steering signal required to control the voltage-controlled amplifiers 34R and 35L disposed in the signal path for the left and right rear channels as will be hereinafter explained.

The output of the differential amplifier 30, which contains the audio difference information of left-minus-right, is fed through a fixed localization EQ 23. This fixed localization EQ 23 further enhances the system so as to provide additional perceived localization to the rear and side of the listener. The fixed localization EQ 23 provides a frequency response to simulate the frequency response of the human ear responding to sound from either side of the listener. Many studies have been done in the area of interaural differences, and these studies have been documented in publications such as "The Audio Engineering Handbook" (Chapter 1: "Principles of Sound and Hearing") and "Audio" Magazine ("Frequency Contouring for Image Enhancement", February, 1985). While in operation the left and right rear speakers of the invention should be located behind the listener, additional separation between the front and rear channels can be achieved by the inclusion of the fixed localization EQ 23. The circuit of the EQ 23 would provide a frequency response approximating that of the frequency response from either 90° or 135°. The design of active filters is commonly known, and anyone possessing normal skill in the art could design a filter with the frequency response characteristics described. The fixed localization EQ 23 can additionally be used to correct frequency response characteristics of a particular vehicle or listening environment. While the addition of a fixed equalization circuit such as this can provide benefits for many applications, it is not necessary that it be included to achieve the desired objects of the invention.

The output of the fixed localization EQ 23 is then fed to a high pass filter 31 and a low pass filter 32 for dividing the audio spectrum into two bands. The low band portion at the output of the low pass filter 32 is applied directly to summing amplifiers 40L and 40R. The output of the high pass filter 31, which contains substantially upper mid band and high band information, is applied to the VCAs 34R and 35L, which control the gain of the high band signal for the right and left outputs, respectively. The outputs of the VCAs 34R and 35L are then applied to summing amplifiers 40R and 40L, respectively. The VCAs 34R and 35L are functional blocks of Rocktron's integrated circuit HUSH TM 2050. Voltage-controlled amplifiers are commonly known and used, and many alternatives may be used for the VCAs 34L and 35R.

The output of the summing amplifier 20, after being processed by a low pass filter 22, is applied to the summing amplifier 40L and an amplifier 41R for providing bass response of the summed channels to the rear left and right outputs 43L and 43R, respectively.

A level sensor 42 receives the output from the high pass filter 31 and is configured so as to provide an increase in DC voltage at the output of the level sensor 42 when the signal energy at the output of the high pass filter 31 drops below −40 dBu, where OdBu=0.775VRMS. The level sensor 42 provides noise reduction aspects for the invention which are desirable due to the fact that, in operation, the boosted difference information fed to the rear channels typically contains much of the high frequency information present in the audio signal. This would, therefore, increase the noise perceived by the listener. Thus the level sensor 42 provides gain reduction or low-level downward expansion for the VCAs 34R and 35L and noise reduction aspects are provided.

Figure 2:
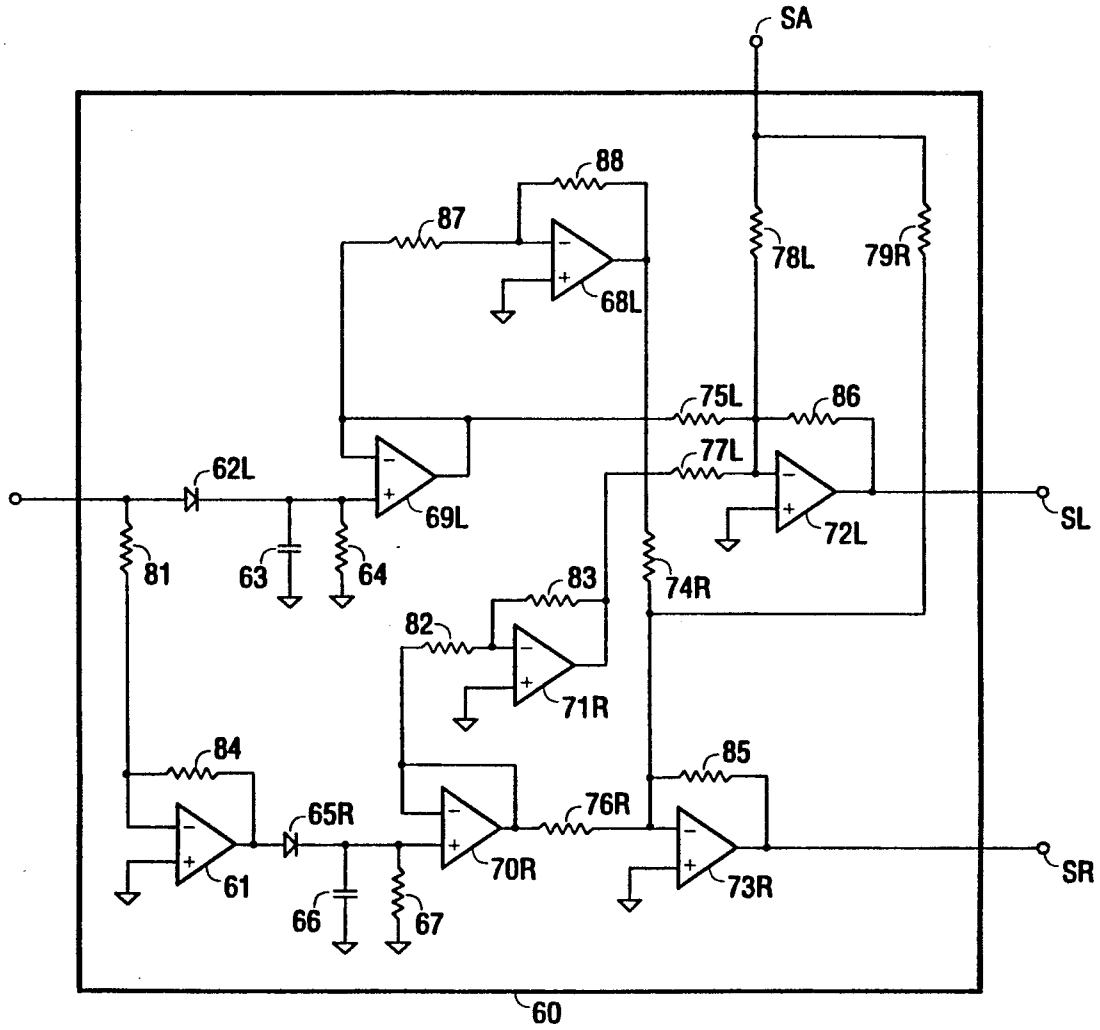
FIG. 2 is a partial block/partial schematic diagram of the steering signal generator of FIGURE I.

Referring to FIG. 2, the steering signal generator 60 receives the substantially-DC output level from the differential amplifier 50. The output from the differential amplifier 50 is applied to an inverting amplifier 61 and a diode 62L. The output of the inverting amplifier 61 will provide a signal of opposite polarity to that of the difference amplifier 50, so that when the left channel has a dominant signal energy, the output of the inverting amplifier 61 will go negative. When the right channel has a dominant signal energy, the output of the inverting amplifier 61 will go positive. The output of the inverting amplifier 61 is applied to another diode 65R. Thus diodes 62L and 65R provide peak detection from the output of the differential amplifier 50 and the inverting amplifier 61, so as to provide a positive-going voltage at the cathode of the first diode 62L when there is a predominant signal energy in the left channel, and a positive-going voltage at the cathode of the other diode 65R when there is a predominant right channel signal. Capacitors 63 and 66 provide filtering, and resistors 64 and 67 provide release characteristics for the positive peak detectors. The time constant of the steering decoder is typically at least two times that of the time constants in the level sensors 14R and 14L so as to avoid any jittering or pumping effects in the decoded-directional signal. Buffer amplifiers 69L and 70R provide isolation for the peak detectors and output drive to drive the additional steering circuitry. The output of one buffer amplifier 69L will provide a positive-going DC voltage with a predominant left channel signal, and the output of the other buffer amplifier 70R will provide a positive-going DC voltage with a predominant right channel signal. The outputs of the buffer amplifiers 69L and 70R are applied to limiters 72L and 73R, respectively, for limiting the maximum voltage possible to drive the voltage-controlled amplifiers 34R and 35L. The limiters 72L and 73R are contained internally to the HUSH 2050 IC as expander control amplifiers which provide an output voltage in one quadrant. These amplifiers are designed to only swing positive and to saturate at zero volts DC. The circuitry is configured such that the limiters 72L and 73R will hit maximum negative swing or zero volts DC at the desired point, providing the maximum gain desired for the VCAs 34R and 35L. In practice, the limiters 72L and 73R will limit, between 3 and 18dB, the maximum output gain from the VCAs 34R and 35L. The outputs of the limiters 72L and 73R are connected to the control ports of the VCAs 35L and 34R, respectively, and through resistors 74R and 75L. The output of the first buffer amplifier 69L is also inverted by an inverting amplifier 68L and cross-coupled through the resistor 74R to the right channel's limiter/control amplifier 73R so as to provide gain reduction to the signal applied to the right channel. Conversely, the inverting amplifier 71R inverts the output of the buffer amplifier 70R so as to provide a negative-going voltage and reduce the gain at the right VCA 34R and de-emphasize the signal energy that is being emphasized by the left VCA 35L. In operation, should there be a predominant high frequency energy in the left channel, the DC voltage at the output of the left level sensor 14L will be larger than the DC voltage at the output of the right level sensor 13R. Therefore, the output of the differential amplifier 50 will be positive-going and the output of the left buffer amplifier 69L will be positive-going, which will provide gain based on the amplitude difference between left and right. The left limiter 72L will determine the maximum amount of gain provided by the left VCA 35L, so as to turn up the left rear channel through the left summing amplifier 40L. However, when the left buffer amplifier 69L is positive, the left inverting amplifier 68L goes negative and applies a negative-going DC signal through the resistor 74R to control the right limiter 73R which controls the right VCA 34R so as to turn down the right rear channel through the right summing amplifier 40R. The opposite is true if signal energy is dominant in the right channel, as the voltage at the output of the right level sensor 14R goes positive, causing the output of the differential amplifier 50 to go negative and invert through the inverting amplifier 61. The right diode 65R then becomes conductive and the output of the right buffer amplifier 70R becomes positive. The maximum amount of gain is determined by the right limiter 73R, and this DC voltage is applied to the control port of the right VCA 34R, which then turns up the right rear channel through the right summing amplifier 40R. The output of the right summing amplifier 40R is then inverted via the inverting amplifier 41R so as to maintain phase coherency between the left front and left rear channels, as well as between the right front and right rear channels. This coherency allows the system to preserve the possibility for side-imaging.

Conversely, the positive output of the right buffer amplifier 70R is inverted through the right inverting amplifier 71R. This negative-going voltage is applied to the left limiter 72L to control the left VCA 35L through a resistor 77, and turns down the left channel. Because the output of the differential amplifier 50 is negative in this case, the left diode 62L is not conductive. While the gain of the VCAs 34R and 35L is limited to between 3 and 18dB, the de-emphasis provided to the opposite channel is typically 15 to 30dB.

Due to the fact that the difference signal contains the majority of spacial information, rear ambience is greatly enhanced for a more natural perception by the listener. Also, due to the fact that the difference information that is dynamically steered through the VCAs 34R and 35L is only upper mid and high frequency information processed by the high pass filter 31, and the lower mid band information that is passed through low pass filter 32 is unaltered, there will be perceived directional information from the rear of the listener. The system provides an extremely fast attack time so as to allow enhancement of transient information. However, there will not be a perceived pumping effect, due to the fact that the steering is not achieved by broadband means. The lower midband signal contains less directional information and, therefore, does not require steering for subjectively excellent results.

A control line SA provides a DC voltage simultaneously to parallel resistors 78L and 79R, which in turn feed the negative inputs to the limiters 72L and 73R, respectively, and provide DC control for the VCAs 34R and 35L through right and left control lines SR and SL. This is a means of providing high band noise reduction when the signal level at the output of the high pass filter 31 drops below approximately −40dBu. The values for the components shown in FIG. 2 are disclosed in Table 1.

TABLE 1

| | | | |
|---|---|---|---|
| 61 | LF 353 | 74L | 39 KΩ |
| 62L | 1N 4148 | 75R | 43 KΩ |
| 63 | .47 μf | 76L | 43 KΩ |
| 64 | 47 OKΩ | 77L | 39 KΩ |
| 65R | 1N 4148 | 78R | 43 KΩ |
| 66 | .47 μf | 79R | 43 KΩ |
| 67 | 47 OKΩ | 81 | 20 KΩ |
| 68L | LF 353 | 82 | 20 KΩ |
| 69L | LF 353 | 83 | 20 KΩ |
| 70R | LF 353 | 84 | 20 KΩ |
| 71R | LF 353 | 85 | 20 KΩ |
| 72L | HUSH 2050 TM | 86 | 20 KΩ |
| 73R | HUSH 2050 TM | 87 | 20 KΩ |
| | | 88 | 20 KΩ |

Figure 6:
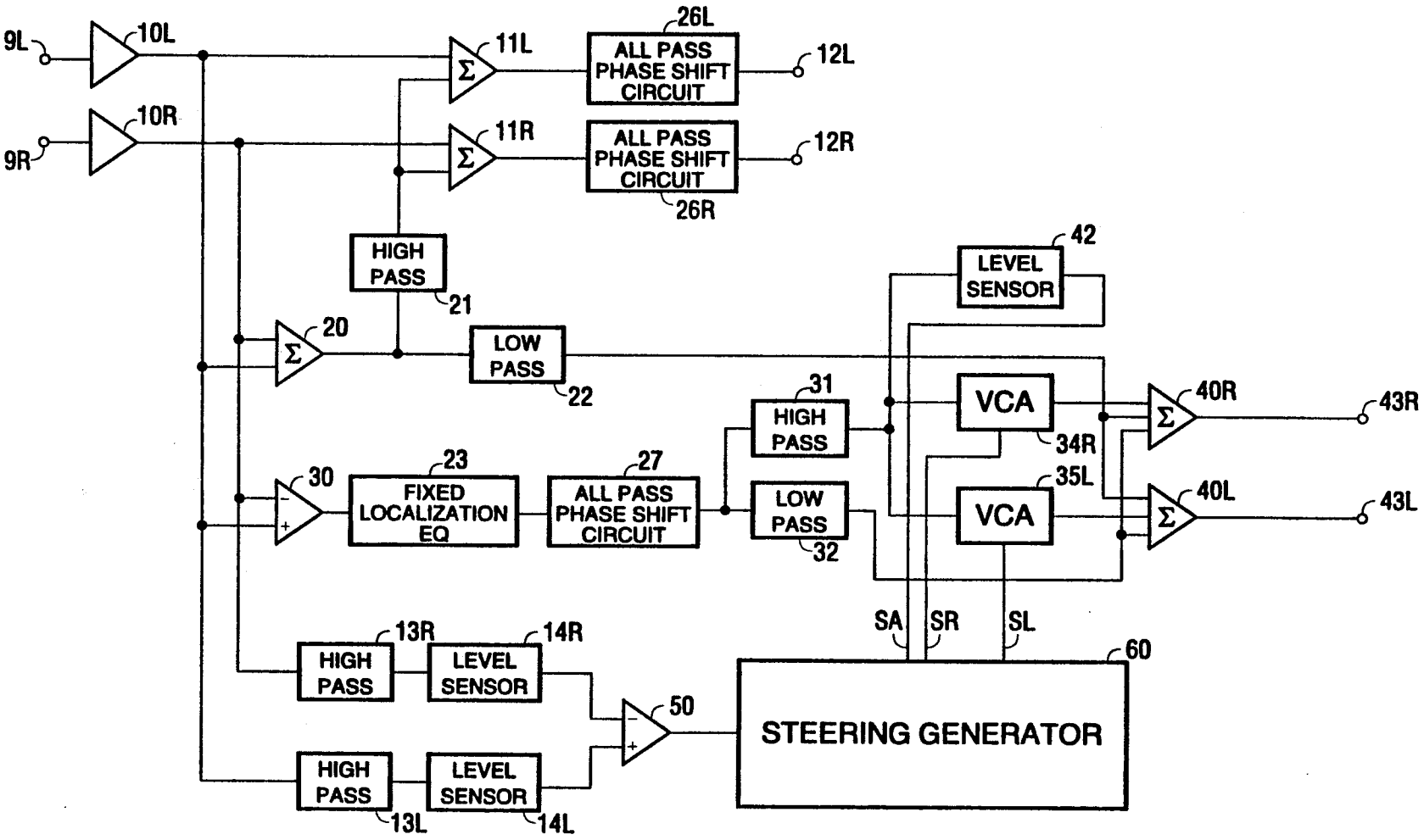
FIG. 6 is a partial block/partial schematic diagram of a phase coherent implementation of the invention.

Now referring to FIG. 6, another embodiment of the invention is illustrated which offers improvements for rear center imaging in that the rear channels are phase-coherent, i.e. not out of phase. To compensate for the phase error that would take place between the right rear and the right front, all-pass phase circuits are inserted. One all-pass phase circuit 27 shifts the phase of the difference information at the output of the fixed localization EQ 23, and provides a phase-shifted signal that is then applied to both the left and right rear outputs 43L and 43R. All-pass filters 26L and 26R shift the phase of the front left and right channels such that the difference between the left front 12L and left rear 43L outputs will be 90° and the difference between the right front 12R and right rear 43R outputs will also be 90°. This compensates for the 180° phase shift that would be present at the right rear output 43R without the phase inversion derived by the amplifier 41R shown in FIG. 1. In this embodiment of the invention, due to the fact that the rear right and left channels are 100% phase coherent, rear center stability is greatly improved. All pass phase circuits such as those disclosed in FIG. 6 are commonly known in the art, and anyone skilled in the art could design all-pass phase shift circuits capable of providing a difference of 90° phase shift between the front and rear channels, as provided by the all pass phase shift circuits 26L, 26R and 27.

Comparing FIGS. 1 and 6, the all-pass filters 26L, 26R and 27 have been inserted and the right inverting amplifier 41R has been omitted. The right inverting amplifier 41R, which corrects the phase error between the right rear 43R and right front 12R in FIG. 1, is omitted in FIG. 6 to regain a stable rear center image due to the fact that the left 43L and right 43R rear channels regain phase coherency. The alternate method shown in FIG. 6 compensates for the 180° phase error that would take place between the right rear 43R and right front 12R by inserting the all-pass circuits 26L, 26R and 27. The bass signal that is fed to the rear channels from the low-pass filter 22 is simply fed to the inputs of both summing amplifiers 40L and 40R.

Figure 7:
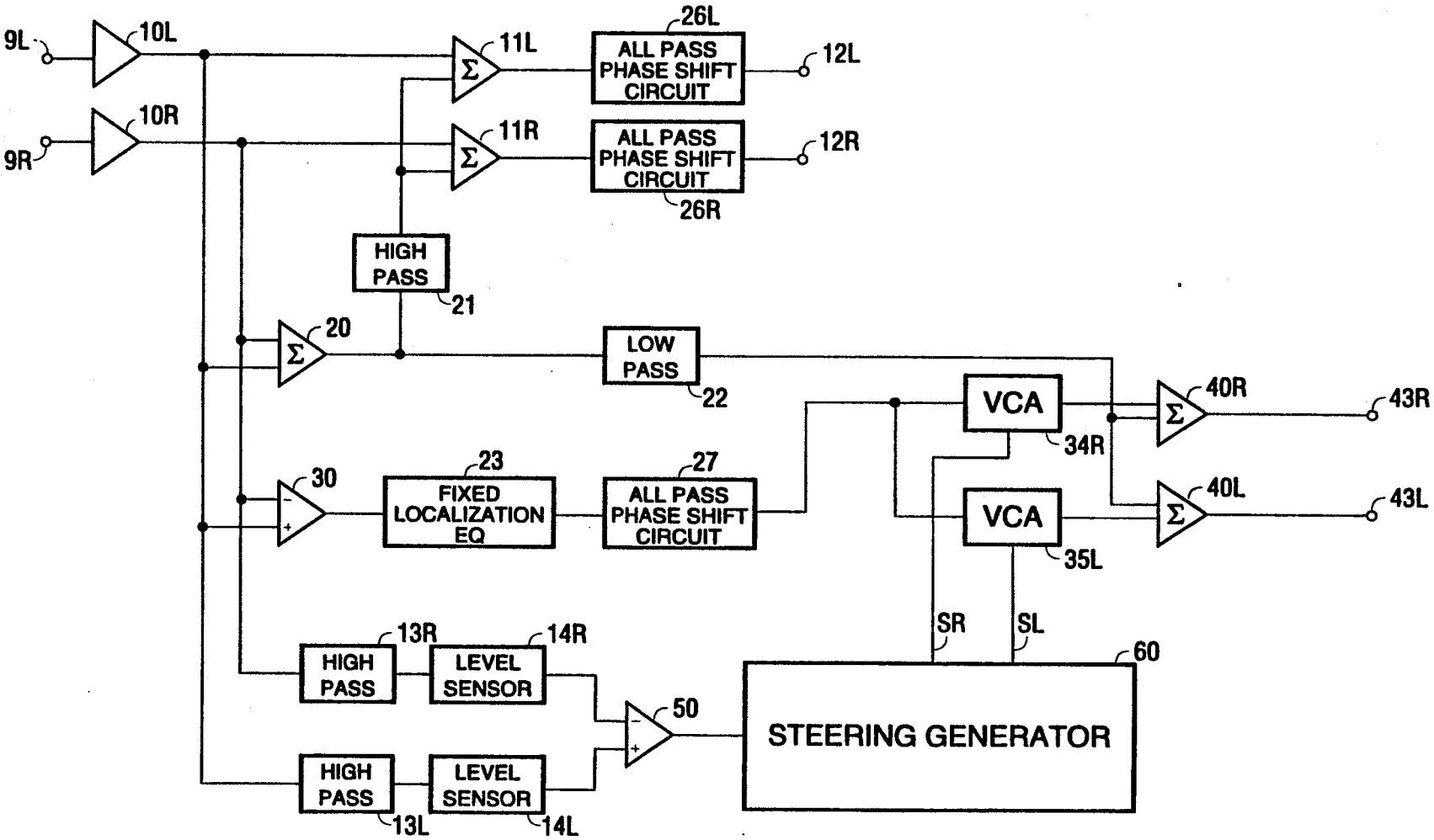
FIG. 7 is a partial block/partial schematic diagram of an alternative phase coherent implementation of the invention.

FIG. 7 illustrates an embodiment of the invention similar to that disclosed in FIG. 6. Common block numbers are used where common functions are performed. In this embodiment, the buffered output signals of the buffer amplifiers 10L and 10R are fed to the differential amplifier 30. The differenced output of the amplifier 30 is then fed to the fixed localization EQ 23, followed by the all pass phase shift circuit 27. The output of the phase shift circuit 27 is then fed directly to both VCAs 34R and 35L, which therefore provide broadband rear channel steering. The summed low pass output 10 of the low pass filter 22 is fed to the summing amplifiers 40R and 40L to provide bass information to the rear channels. This low frequency information also assists in preventing any perceived image-wandering in the rear channels, as well as pumping affects that can occur when steering broadband signals.

Figure 8:
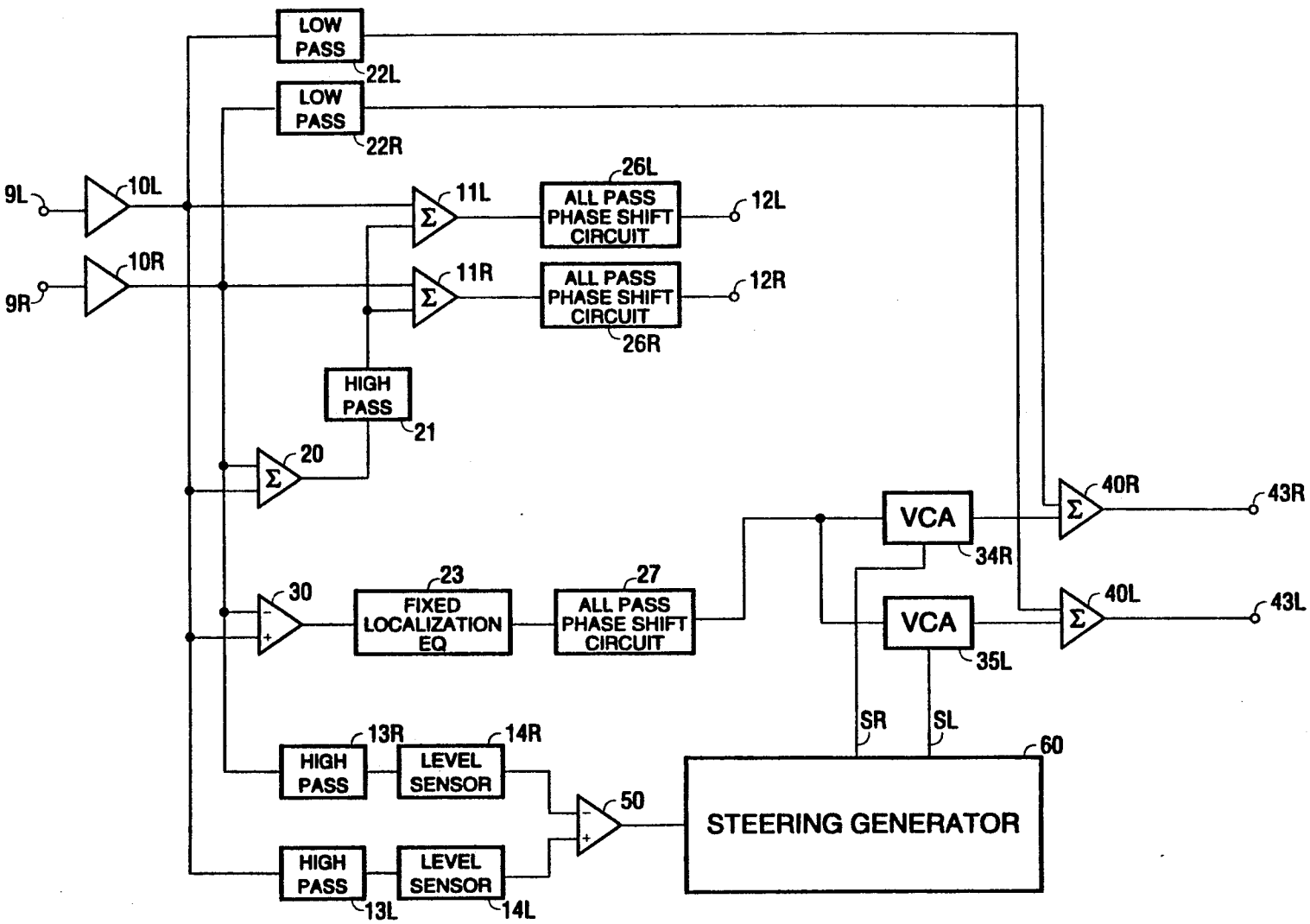
FIG. 8 is a partial block/partial schematic diagram of yet another phase coherent implementation of the invention.

FIG. 8 discloses yet another embodiment of the invention having another means of providing low frequency information to the rear channels. Common block numbers are used where common functions are performed. In this embodiment, the buffered outputs of the buffer amplifiers 10L and 10R ar individually fed to low pass filters 22L and 22R, respectively, and fed directly to the summing amplifiers 40L and 40R. Low pass filtering the individual buffered inputs maintains stereo separation of the rear channel bass content. A further improvement is gained by raising the corner frequency of the low pass filters 22L and 22R to include lower mid band information. This will increase the listener perception of this stereo separation, as well as assist in preventing any perceived image-wandering or pumping effects in the rear channels.

Figure 3:
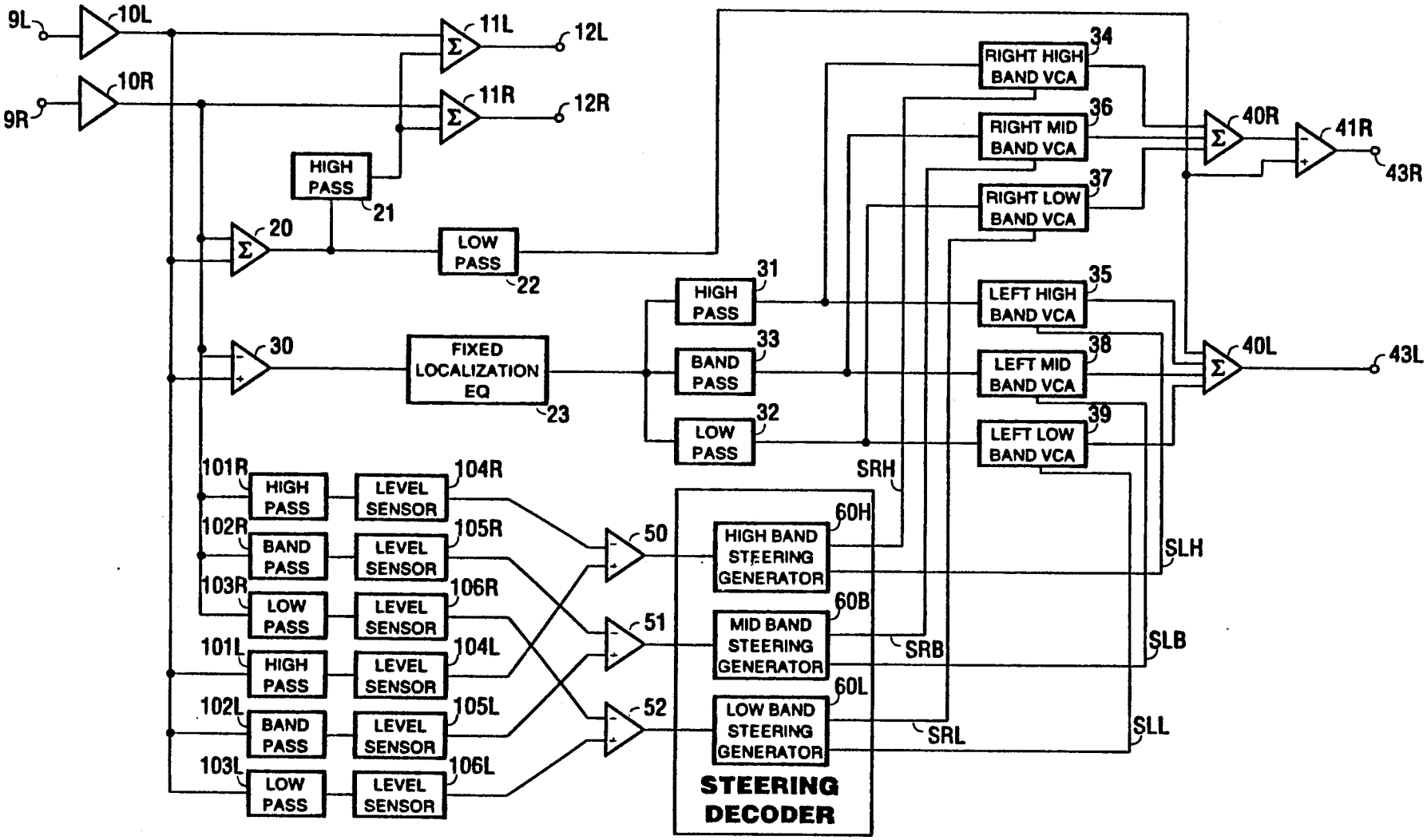
FIG. 3 is a partial block/partial schematic diagram of a three-band implementation of the present invention.

Referring now to FIG. 3, a more elaborate implementation of the invention than that shown in FIG. 1 is disclosed. Block numbers common to FIG. 1 are used where common functions are performed.

Left and right inputs 9L and 9R, respectively, are buffered by the buffer amplifiers 10L and 10R. Summing amplifiers 11L and 11R receive the buffered outputs from the buffer amplifiers 10L and 10R. The left/-right summing amplifier 20 also receives the outputs from the buffer amplifiers 10L and 10R and provides the sum of left-plus-right. The summed signal from this summing amplifier 20 is filtered through the high pass filter 21 and summed with the buffered left/right channel information by summing amplifiers 11L and 11R to provide composite left-front 12L and right-front 12R outputs. The outputs from the buffer amplifiers 10L and 10R are also fed to the differential amplifier 30 to provide a signal equal to left-minus-right. This difference signal is then fed to the fixed localization EQ23, which is identical to that disclosed and discussed in FIG. 1. The output of the fixed localization EQ 23 is then split into three discrete bands via a high pass filter 31, a band pass filter 33 and a low pass filter 32. The outputs from the buffer amplifiers 10L and 10R are also each split into three discrete bands. The buffered left channel signal is fed to a high pass filter 101L, a band pass filter 102L and a low pass filter 103L. Likewise, the buffered right channel signal is fed to a high pass filter 101R, a band pass filter 102R and a low pass filter 103R. The outputs from the left filters 101–103L and the right filters 101-103R are then fed to left and right level sensors 104–106L and 104–106R, respectively, which provide a substantially DC output equal to the absolute value of the logarithm of the energy present in each discrete band.

Figure 4:
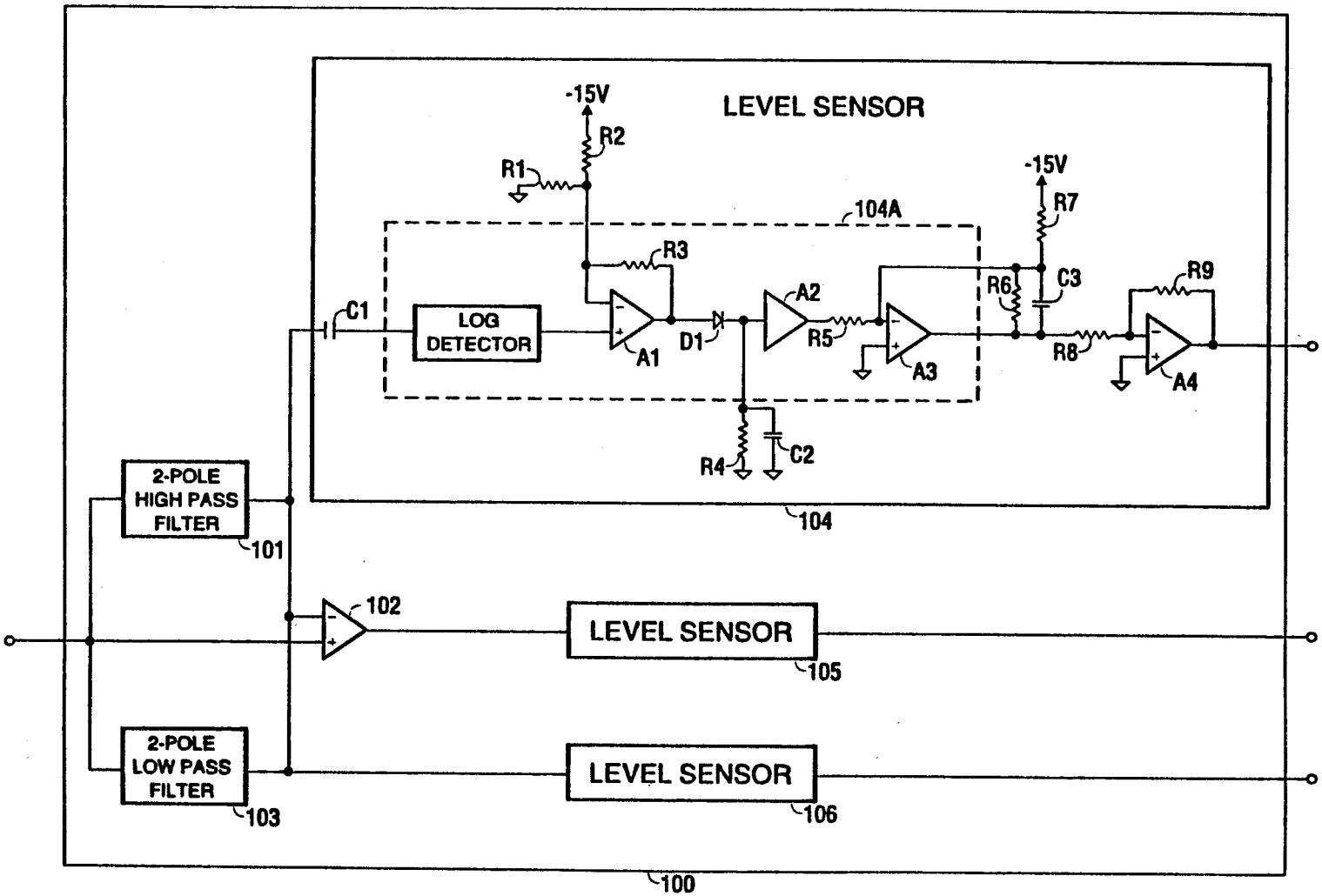
FIG. 4 is a partial block/partial schematic diagram of the multi-band level sensor of FIG. 3.

Referring now to FIG. 4, a partial block/partial schematic diagram of the circuitry contained in block 100 of FIG. 3 illustrates both the filtering network 101–103 and the level sensors 104–106 for either channel, i.e. left or right. The filter networks 101, 102 and 103 are commonly known in the art and include a 2-pole high pass filter at the output of the high pass network 101 and a 2-pole low pass filter at the output of the low pass network 103. The outputs of the high pass network 101 and the low pass network 103 are summed at the negative input of a differential amplifier 102. The direct input is fed to the positive input of the differential amplifier 102. The difference output will be equal to the midrange information present in the input signal. The 2-pole high pass filter 101 has an output passing frequencies above approximately 4 KHz, the low pass filter 103 has an output passing frequencies below approximately 500 Hz and the bandpass filter 102 has an output passing the frequencies between the high pass filter 101 and the low pass filter 103. Other frequencies may be used as alternatives to those disclosed. The outputs from each of the filter sections are processed by a level sensor. One level sensor 104, disclosed in detail for the high pass filter 101, is virtually identical to the other level sensors 105 and 106. The function of the level sensor 104 is served by the custom integrated circuit HUSH TM 2050. The HUSH TM 2050 IC contains the circuitry 104A shown in FIG. 4. The output of the high pass filter 101 is AC coupled through a capacitor C1 to the input of a log detector which provides the logarithm of the absolute value of the input signal. The log detected output is applied to the positive input of an amplifier A1, which sets the gain of the full wave rectified, log-detected signal by a feedback resistor R3 and a gain-determining resistor R1. Another resistor R2 provides a DC offset so that the output of the amplifier Al operates within the proper DC range. The output of the amplifier Al is then peak-detected by a diode D1 and filtered by a capacitor C2. The filter capacitor C2 and a resistor R4 determine the time constant for the release characteristics of the level sensor 104. This filtered signal is then buffered by a buffer amplifier A2 and inverted by a unity gain inverting amplifier A3. The output of the inverting amplifier A3 feeds an input resistor R8 and is then fed to the negative input of an operational amplifier A4. A feedback resistor R9 provides negative feedback to the operational amplifier A4. The output of operational amplifier A4 is a positive-going DC signal, linear in volts-per-decibel, proportional to the input signal level applied to the input of the level sensor 104. The circuitry disclosed in FIG. 4 is virtually identical to that of the level sensors 13L and 13R in FIG. 1. The time constants may vary. The values for the components shown in FIG. 4 are listed in TABLE 2.

TABLE 2

| | | | |
|---|---|---|---|
| A1 | LF 353 | R1 | 1 KΩ |
| A2 | LF 353 | R2 | 91 KΩ |
| A3 | LF 353 | R3 | 10 KΩ |
| A4 | LF 353 | R4 | 1 MΩ |
| 102 | LF 353 | R5 | 20 KΩ |
| C1 | .47 Mfd | R6 | 20 KΩ |
| C2 | .1 Mfd | R7 | 150 KΩ |
| C3 | 470 pf | R8 | 20 KΩ |
| D1 | 1N 4148 | R9 | 20 KΩ |

Referring again to FIG. 3, the outputs of all the level sensors 104–106L and 104–106R are positive-going DC voltages proportional to the output signal energy at the outputs of the filters 101–103L and 101–103R. The differential amplifier 50 provides a positive-going output with a predominant signal energy in the high-band portion of the left channel and a negative-going output with a predominant signal energy in the high-band portion of the right channel. A differential amplifier 51 provides a positive-going output with a predominant signal energy in the mid-band portion of the left channel and a negative-going output with a predominant signal energy in the mid-band portion of the right channel. Likewise, a differential amplifier 52 provides a positive-going output with a predominant signal energy in the low-band portion of the left channel and a negative-going output with a predominant signal energy in the low-band portion of the right channel. The outputs of the differential amplifiers 50, 51 and 52 feed the steering generators 60H, 60B and 60L of a steering decoder 80, respectively. The steering generators 60H, 60B and 60L are each virtually identical to the steering generator 60 disclosed in FIG. 2. The high pass steering generator 60H determines the left/right steering characteristics for the high-band portion of the audio spectrum, the mid band steering generator 60B determines the left/-right steering characteristics for the mid-band and the low pass steering generator 60L determines the left/-right steering characteristics for the low-band. The outputs of each of these steering generators provide the proper DC voltage to control the VCAs 34–39 disposed in the audio signal path for the right and left rear outputs. These VCAs control the high, mid and low-band portions of the audio spectrum so as to enhance directional information for the left 43L and right 43R rear outputs. The audio inputs to the high band VCAs 34 and 35 are fed from the high pas filter 31, the audio inputs to the mid band VCAs 36 and 38 are fed from a band pass filter 33 and the audio inputs to the low band VCAs 37 and 39 are fed from the low pass filter 32. The outputs of the right VCAs 34, 36 and 37 are summed through the amplifier 40R, so as to provide a composite output of the entire spectrum of difference information that has been divided into a plurality of bands by the filters 31, 32 and 33. Likewise, the summing amplifier 40L combines the audio outputs of the left VCAs 35, 38 and 39 to provide a composite output of the entire spectrum of difference information processed by the filters 31, 32 and 33.

The signal summed at the summing amplifier 20 is also low pass filtered through the low pass filter 22 and fed to the input of the left summing amplifier 40L to provide bass content as a portion of the signal of the left rear output 43L. The output of the low pass filter 22 is also fed to the positive input of the differential amplifier 41R to provide bass content as a portion of the signal of the right rear output 43R. The differential amplifier 41R differences the low pass filtered output of the low pass filter 22 and the output of the right summing amplifier 40R to maintain proper phase coherency between the right rear 43R and right front 12R channels.

In operation, the left and right buffered outputs from the buffer amplifiers 10L and 10R are each divided into a three band spectrum, processed by the high pass, low pass and band pass filters. The level sensors 104–106L and 104–106R following the outputs of the filters provide DC signal levels representative of the spectral energy present in each band of each channel. These DC signal levels are fed to the differential amplifiers 50, 51 and 52 which provide positive or negative steering information based on the predominant signal energy contained in each portion of the spectrum. The steering decoder 80 then provides proper DC control steering signals for the VCAs disposed in the signal path for the right and left rear outputs 43R and 43L.

The left and right input signals buffered by the buffer amplifiers 10L and 10R, respectively, are differenced by the amplifier 30 and divided into high, mid and low bands by the filters 31, 32 and 33. The outputs of these filters are then applied to the inputs of the VCAs 34–39. The VCAs 34–39 provide the proper emphasis or de-emphasis for each band within each channel. The composite system, as disclosed in FIG. 3, allows for a predominant high frequency signal to be emphasized in the left channel via the left high band VCA 35 and de-emphasized in the right channel via the left high band VCA 35, while simultaneously emphasizing a predominant mid frequency signal in the right channel via the right mid band VCA 36 and de-emphasizing that mid frequency signal in the left channel via the left mid band VCA 38. Thus it can be seen that in this embodiment it is possible to provide instantaneous emphasis into the left 43L and right 43R rear channels, based on signal energy present in various portions of the audio spectrum.

Figure 5:
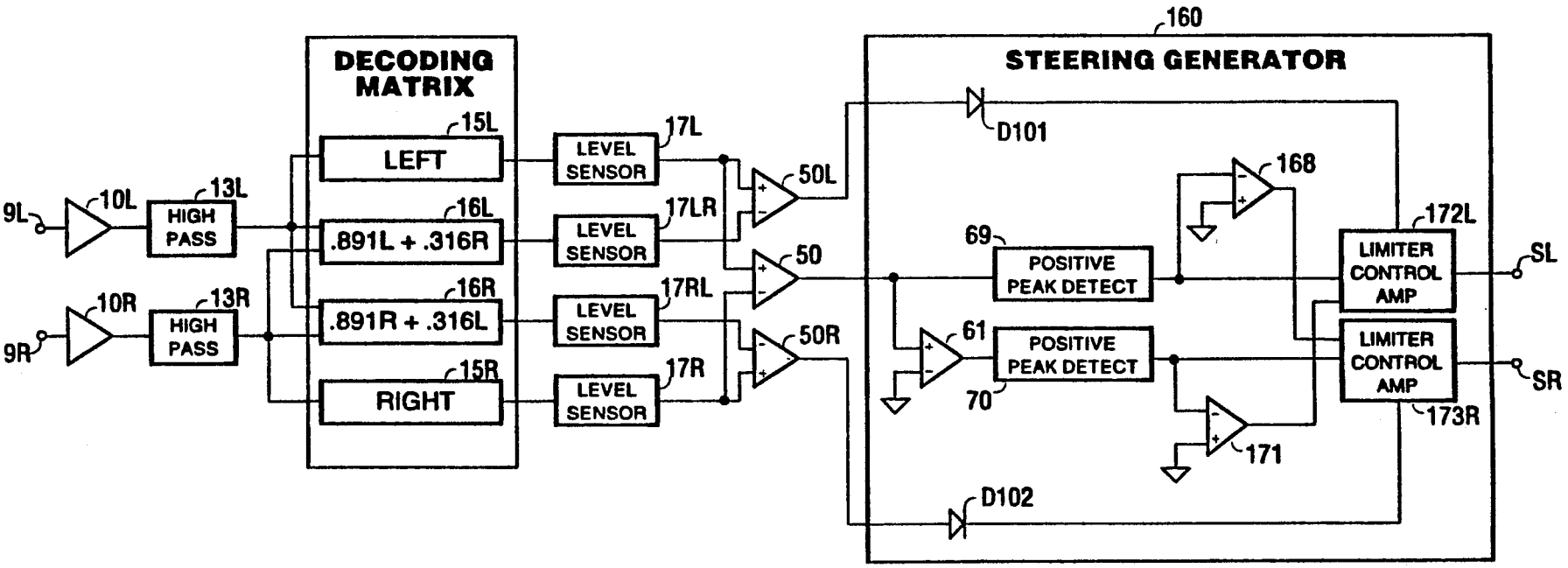
FIG. 5 is a partial block/partial schematic diagram of another embodiment of the invention incorporating further enhancements for improving decoded localization of audio signals.

Now referring to FIG. 5, yet another embodiment of the invention incorporating further enhancements for improving localization of the decoded audio signals is illustrated. Common numbers are used to denote common circuit functions to those of other figures.

Left/right audio inputs 9L and 9R are buffered by buffer amplifiers 10L and 10R. The buffered output signals are then high pass filtered to provide substantially upper mid and high frequency information at the outputs of the high pass filters 13L and 13R. The decoding matrix contains matrixing circuits 15L, 16L, 16R and 15R, where 15L is strictly information contained in the high pass filtered left signal at unity gain, 15R is strictly information contained in the high pass filtered right signal at unity gain, 16L provides (left x 0.891)+(right x 0.316) and 16R provides (right x 0.891)+(X 0.316). The outputs from the decoding matrix each feed a level sensor (17L, 17LR, 17RL and 17R) which provide substantially DC outputs proportional to the logarithm of the absolute value of the signal energy contained in the outputs of the decoding matrix. The level sensor 17L, which reflects strictly left signal information is fed to the positive input of a differential amplifier 50L, while the minus input of the differential amplifier 50L is fed by the level sensor 17LR, which contains predominantly left signal information plus a small portion of right. The exclusive left and right outputs from the level sensors 17L and 17R, respectively, are fed to the positive and negative inputs, respectively, of a differential amplifier 50 virtually identical to that disclosed in FIG. 1. The output of the difference amplifier 50 will be positive with a predominant signal energy in the left band and negative with a predominant signal energy in the right band. The output of the level sensor 17RL which provides a DC signal representative of predominantly right signal information plus a small portion of left is fed to the negative input of a differential amplifier 50R, while the output of the level sensor 17R, representing strictly right channel information is fed to the positive input of the amplifier 50R. The decoding matrix, level sensors and difference amplifiers operate in unison to provide a DC output at the difference amplifier 50 which is positive when predominant signal energy is in the left channel and negative when predominant signal energy is in the right channel. The difference amplifier 50L provides a DC output which is positive only when the signal energy is predominantly left by greater than 10dB over the signal energy present in the right channel input. Conversely, the difference amplifier 50R provides a DC output which is positive only when the signal energy is predominantly right by greater than 10dB over the signal energy present in the left channel input.

Steering generator 160 is similar to that disclosed in FIGURE 2. However, it has been re-configured so that limiter/control amps 172L and 173R will provide unity gain to the rear channel VCAs 34R and 35L, i.e. it will not provide upward expansion or emphasis to the left or right rear channel when the difference in signal energy between the left and right inputs is less than 10dB. However, a de-emphasis of the opposite channel will be achieved through inverting amplifiers 168 and 171 when a predominant signal energy (less than 10dB) is detected in one channel. For example, if a predominant signal energy is detected in the left channel (less than 10dB more than that of the right), no control voltage will be present on the output SL, but a control voltage will be present on the output of SR so as to attenuate the signal within the high band portion of the spectrum for the right channel. Conversely, if a predominant signal energy is detected in the right channel (less than 10dB more than that of the left), no control voltage will be present on the output SR, but a control voltage will be present on the output SL so as to attenuate the signal within the high band portion of the spectrum for the left channel.

In operation, the left limiter 172L will limit at a predefined maximum VCA gain between 0dB and +3dB with difference information less than 10dB. Only when the signal energy is predominantly left by greater than 10dB will the output of the difference amplifier 50L, processed through a diode D101, increase the limiting point of the left limiter 72 to increase the emphasis into the left channel. Conversely, the right limiter 73R is also configured so as to limit VCA gain between 0dB and +3dB. Only when the signal energy is predominantly right by greater than 10dB will the output of the difference amplifier 50R, processed through a diode D102, increase the limiting point of the right limiter 73R to increase the emphasis into the right channel via the right channel's VCA 34R.

The embodiment disclosed in FIG. 5 allows for a given individual signal to be localized at any location within 360° of the listener, dependent upon the amount that the given signal is panned to the left or to the right input. A composite input signal would require that the energy level in one channel be at least 10dB greater than that of the other channel before the rear channel information will begin to be emphasized.

While a number of embodiments have been disclosed with various features for enhancing the basic concepts of the invention, the invention also lends itself to implementation as a DSP software algorithm. In a DSP implementation, it would be conceivable to divide the audio spectrum into a larger number of frequency bands to get even better frequency resolution, thereby providing better localization at specific frequency bands within the audio spectrum. The further enhancements that can be provided through a DSP implementation will become apparent to those skilled in the art, and are well within the scope of the invention.

The invention disclosed has been reduced to practice where many of the circuit functions are performed by the custom integrated circuit HUSH 2050 TM. The 2050 IC is a proprietary IC developed by Rocktron Corporation, and contains log-based detection circuits, voltage-controlled amplifiers and VCA control circuitry. The basic functions of the generalized blocks of the 2050 IC are well known to those skilled in the art. Many alternatives exist as standard product ICs from a large number of IC manufacturers, as well as discrete circuit design.

The invention is intended to encompass all such modifications and alternatives as would be apparent to those skilled in the art. Since many changes may be made in the above apparatus without departing from the scope of the invention disclosed, it is intended that all matter contained in the above description and accompanying drawings shall be interpreted in an illustrative sense, and not a limiting sense.

What is claimed is:

1. A circuit for decoding two channel stereo signals into multi-channel sound signals comprising:
   - means for differencing the two channel stereo signals to provide a primary signal;
   - means for dividing said primary signal into a plurality of bands to provide a plurality of split frequency band signals;
   - means for determining a dominant one of the two channel stereo signals; and
   - means for dynamically varying the level of at least one of said split band signals in response to the dominant of the two channel stereo signals to produce an audio output signal.

2. A circuit for decoding two channel stereo signals into multi-channel sound signals comprising:
   - means for differencing the two channel stereo signals to provide a primary signal;
   - means for dividing said primary signal into a plurality of bands to provide a plurality of split frequency band signals;

means for dynamically varying the level of at least one of said split frequency band signals to produce a first dynamically varied signal; and means for controlling the gain of said varying means to increase the level of said first dynamically varied signal when the level of one of the two channel signals is high relative to the other and to decrease the level of said first dynamically varied-signal when the level of the other of the two channel signals is high relative to said one.

3. A circuit according to claim 2, said dividing means comprising:

means for filtering said primary signal to provide a high and mid frequency band signal; and means for filtering said primary signal to provide a low frequency band signal.

4. A circuit according to claim 2, said controlling means comprising:

means for deriving a first dc signal proportional to one of the two channel stereo signals;

means for deriving a second dc signal proportional to the other of the two channel stereo signals;

means for differencing said first and second dc signals to provide a dc control signal which is positive when one of the two channel stereo signals is dominant and which is negative when the other of the two channel stereo signals is dominant; and means for impressing positive and negative gains on said varying means in response to said positive and negative conditions of said dc control signal.

5. A circuit according to claim 2 further comprising:

second means for dynamically varying the level of said at least one of said plurality of split frequency band signals to produce a second dynamically varied signal; and means for controlling the gain of said second varying means to increase the level of said second dynamically varied signal when the level of the other of the two channel signals is high and to decrease the level of said second dynamically varied signal when the level of the one of the two channel signals is high.

6. A circuit according to claim 1 further comprising means for enhancing said primary signal before said primary signal is divided into said plurality of bands.

7. A circuit according to claim 6, said enhancing means comprising means for providing fixed localization equalization simulating the frequency response characteristics of the human ear.

8. A circuit according to claim 5 further comprising means for combining another of said split frequency band signals with said first dynamically varied signal to produce a composite signal.

9. A circuit according to claim 5 further comprising means for deriving low frequency response components of said two channel stereo signals.

10. A circuit according to claim 9 further comprising means for adding said low frequency response components of said two channel stereo signals to said second dynamically varied signal.

11. A circuit according to claim 10, said adding means comprising:

means for combining the two channel stereo signals into a summed signal;

means for filtering said summed signal to derive a low frequency signal; and means for combining said low frequency signal with said second dynamically varied signal.

12. A circuit according to claim 10, said adding means comprising:

means for combining the two channel stereo signals into a summed signal;

means for filtering said summed signal to derive a low frequency signal; and means for combining said low frequency signal with said second dynamically varied signal and another of said split frequency band signals to produce a first output signal.

13. A circuit according to claim 9 further comprising means for combining another of said split frequency band signals with said first dynamically varied signal to produce a composite signal.

14. A circuit according to claim 13 further comprising means for differencing said composite signal and said low frequency response components to produce a phase coherent second output signal.

15. A circuit according to claim 8 further comprising:

means for combining the two channel stereo signals into a summed signal;

means for filtering said summed signal to derive a low frequency signal; and means for combining said low frequency signal with said second dynamically varied signal and another of said split frequency band signals to produce a first output signal.

16. A circuit according to claim 15 further comprising means for differencing said composite signal and said low frequency signal to produce a phase coherent second output signal.

17. A circuit according to claim 5, said controlling means comprising:

means for deriving a first dc signal proportional to one of the two channel stereo signals;

means for deriving a second dc signal proportional to the other of the two channel stereo signals;

means for differencing said first and second dc signals to provide a dc control signal which is positive when one of the two channel stereo signals is dominant and which is negative when the other of the two channel stereo signals is dominant; and means for impressing positive gains on said first varying means and negative gains on said second varying means when said dc control signal is positive and for impressing positive gains on said second varying means and negative gains on said first varying means when said dc control signal is negative.

18. A circuit according to claim 4, said means for deriving a first dc signal comprising:

means for high pass filtering said one of the two channel stereo signals to provide a first filtered signal; and means for level sensing said first filtered signal; said means for deriving a second dc signal comprising:

means for high pass filtering said other of the two channel stereo signals to provide a second filtered signal; and means for level sensing said second filtered signal.

19. A circuit according to claim 18, each of said level sensing means comprising means for deriving a signal proportional to the log of the absolute value of its respective said first and second filtered signals.

20. A circuit according to claim 18, each of said level sensing means having means for maintaining the time constant of its respective first and second dc signals at a relatively fast rate.

21. A circuit according to claim 5 further comprising means for deriving a first dc signal proportional to one of the two channel stereo signals;
means for deriving a second dc signal proportional to the other of the two channel stereo signals;
means for differencing said first and second dc signals to provide a dc control signal which is positive when one of the two channel stereo signals is dominant and which is negative when the other of the two channel stereo signals is dominant; and
means for controlling the gain of said first dynamically varying means to increase the level of said first dynamically varied signal when the level of said one of the two channel signals is high and to decrease the level of said first dynamically varied signal when the level of the other of the two channel signals is high and for controlling the gain of said second dynamically varying means to increase the level of said second dynamically varied signal when the level of the other of the two channel signals is high and to decrease the level of said second dynamically varied signal when the level of the one of the two channel signals is high.

22. A circuit according to claim 21, said means for deriving a first dc signal comprising:
means for high pass filtering said one of the two channel stereo signals to provide a first filtered signal; and
first means for level sensing said first filtered signal; said means for deriving a second dc signal comprising:
second means for high pass filtering said other of the two channel stereo signals to provide a second filtered signal; and
means for level sensing said second filtered signal.

23. A circuit according to claim 22 further comprising third means for sensing the level of said at least one of said split band signals and for providing a dc voltage to each of said first and second level sensing means which increases in response to a decrease in level beneath a threshold level of said at least one of said split band signals.

24. A circuit for decoding two channel stereo signals into multi-channel sound signals comprising:
means for differencing the two channel stereo signals to provide a primary signal;
means for dividing said primary signal into a plurality of bands to provide a plurality of split frequency band signals;
first means for dynamically varying the level of one of said split frequency band signals to provide a first dynamically varied signal;
second means for dynamically varying the level of another of said split frequency band signals to produce a second dynamically varied signal;
means for deriving a first dc signal proportional to one of the two channel stereo signals;
means for deriving a second dc signal proportional to the other of the two channel stereo signals;
means for differencing said first and second dc signals to provide a dc control signal which is positive when one of the two channel stereo signals is dominant and which is negative when the other of the two channel stereo signals is dominant; and
means for controlling the gain of said first varying means to increase the level of said first varied signal when the level of said one of the two channel signals is high and to decrease the level of said second varied signal when the level of said one of the two channel signals is high and for controlling the gain of said second varying means to increase the level of said second varied signal when the level of said other of the two channel signals is high and to decrease the level of said first varied signal when the level of said another of the two channel signals is high.

25. A circuit according to claim 24, said controlling means comprising:
means for inverting said dc control signal to provide an opposite polarity dc control signal which is negative when said one of the two channel stereo signals is dominant and which is positive when said other of the two channel stereo signals is dominant;
means for rectifying said dc control signal to provide a first positive voltage when said one of said two channel stereo signals is dominant;
means for applying said first positive voltage to a control port of said second varying means;
means for rectifying said opposite polarity dc control signal to provide a second positive voltage when said other of said two channel stereo signals is dominant; and
means for applying said second positive voltage to a control port of said first varying means.

26. A circuit according to claim 25, said controlling means further comprising:
means for limiting said first positive voltage applied to said one control port to a maximum level; and
means for limiting said second positive voltage applied to said other control port to a maximum level.

27. A circuit according to claim 26, said controlling means further comprising:
means for inverting said first positive voltage;
means for cross coupling said inverted first positive voltage to said means for limiting said second positive voltage;
means for inverting said second positive voltage; and
means for cross coupling said inverted second positive voltage to said means for limiting said first positive voltage.

28. A circuit according to claim 27, said means for deriving a first dc signal comprising:
means for high pass filtering said one of the two channel stereo signals to provide a first filtered signal; and
means for level sensing said first filtered signal; said means for deriving a second dc signal comprising:
means for high pass filtering said other of the two channel stereo signals to provide a second filtered signal; and
means for level sensing said second filtered signal.

29. A circuit according to claim 28, each of said level sensing means comprising means for deriving a signal proportional to the log of the absolute value of its respective said first and second filtered signals.

30. A circuit according to claim 28, each of said level sensing means having means for maintaining the time constant of its respective first and second dc signals at a relatively fast rate.

31. A circuit according to claim 30, said controlling means further comprising first and second means for maintaining the time constants of said first and second positive voltages, respectively, at a rate at least twice as fast as said relatively fast rate.

32. A circuit according to claim 24 further comprising:

means for combining the two channel stereo signals into a summed signal;

means for filtering said summed signal to derive a low frequency signal;

means for combining said low frequency signal with said second dynamically varied signal and another of said split frequency band signals to produce a first output signal; and means for combining another of said split frequency band signals with said first dynamically varied signal to produce a composite signal.

33. A circuit according to claim 32 further comprising means for inverting said composite signal in response to said low frequency response components to produce a second output signal.

34. A circuit according to claim 24 further comprising mean for shifting the phase of said primary signal to provide a phase-shifted signal to said dividing means.

35. A circuit according to claim 34 further comprising:

means for combining the two channel stereo signals;

means for deriving low frequency response components of said combined two channel stereo signals;

means for combining said low frequency response components with said second dynamically varied signal and another of said split frequency band signals to produce a first output signal; and means for combining said low frequency response components with said first dynamically varied signal and another of said split frequency band signals to produce a second output signal.

36. A circuit according to claim 35 further comprising:

means for high pass filtering said combined two channel stereo signals to produce a base signal;

means for combining said base signal with said one of said two channel stereo signals to produce a first conditioned signal;

means for shifting the phase of said first conditioned signal to produce a third output signal 90 degrees out of phase with said second output signal;

means for combining said base signal with said other of said two channel stereo signals to produce a second conditioned signal;

means for shifting the phase of said second conditioned signal to produce a fourth output signal 90 degrees out of phase with said first output signal.

37. A circuit for decoding two channel stereo signals into multi-channel sound signals comprising:

means for differencing the two channel stereo signals to provide a primary signal;

means for shifting the phase of said primary signal to provide a phase-shifted signal;

first means for dynamically varying the level of said phase-shifted signal to provide a first dynamically varied signal;

second means for dynamically varying the level of said phase-shifted signal to produce a second dynamically varied signal;

means for deriving a first dc signal proportional to one of the two channel stereo signals;

means for deriving a second dc signal proportional to the other of the two channel stereo signals;

means for differencing said first and second dc signals to provide a dc control signal which is positive when one of the two channel stereo signals is dominant and which is negative when the other of the two channel stereo signals is dominant; and means for controlling the gain of said first varying means to increase the level of said first varied signal when the level of said one of the two channel signals is high and to decrease the level of said second varied signal when the level of said one of the two channel signals is high and for controlling the gain of said second varying means to increase the level of said second varied signal when the level of the of the two channel signals is high and to decrease the level of said first varied signal when the level of the other of the two channel signals is high.

38. A circuit according to claim 37 further comprising:

means for combining the two channel stereo signals;

means for deriving low frequency response components of said combined two channel stereo signals;

means for combining said low frequency response components with said second dynamically varied signal to produce a first output signal; and means for combining said low frequency response components with said first dynamically varied signal to produce a second output signal.

39. A circuit according to claim 38 further comprising:

means for high pass filtering said combined two channel stereo signals to produce a base signal;

means for combining said base signal with said one of said two channel stereo signals to produce a first conditioned signal;

means for shifting the phase of said first conditioned signal to produce a third output signal 90 degrees out of phase with said second output signal;

means for combining said base signal with said other of said two channel stereo signals to produce a second conditioned signal;

means for shifting the phase of said second conditioned signal to produce a fourth output signal 90 degrees out of phase with said first output signal.

40. A circuit for decoding two channel stereo signals into multi-channel sound signals comprising:

means for differencing the two channel stereo signals to provide a primary signal;

means for shifting the phase of said primary signal to provide a phase-shifted signal;

first means for dynamically varying the level of said phase-shifted signal to provide a first dynamically varied signal;

second means for dynamically varying the level of said phase-shifted signal to produce a second dynamically varied signal;

means for deriving a first dc signal proportional to one of the two channel stereo signals;

means for deriving a second dc signal proportional to the other of the two channel stereo signals;

means for differencing said first and second dc signals to provide a dc control signal which is positive when one of the two channel stereo signals is dominant and which is negative when the other of the two channel stereo signals is dominant;

means for controlling the gain of said first varying means to increase the level of said first varied signal when the level of said one of the two channel signals is high and to decrease the level of said second varied signal when the level of said one of the two channel signals is high and for controlling the gain of said second varying means to increase the level of said second varied signal when the level of the another of the two channel signals is high and to decrease the level cf said first varied signal when the level of the other of the two channel signals is high;

means for deriving low frequency response components of said one of said two channel stereo signals;

means for combining said low frequency response components of said one of said two channel stereo signals with said second dynamically varied signal to produce a first output signal;

means for deriving low frequency response components of said other of said two channel stereo signals; and means for combining said low frequency response components of said other of said two channel stereo signals with said first dynamically varied signal to produce a first output signal.

41. A circuit according to claim 40 further comprising:

means for combining the two channel stereo signals;

means for high pass filtering said combined two channel stereo signals to produce a base signal;

means for combining said base signal with said one of said two channel stereo signals to produce a first conditioned signal;

means for shifting the phase of said first conditioned signal to produce a third output signal 90 degrees out of phase with said second output signal;

means for combining said base signal with said other of said two channel stereo signals to produce a second conditioned signal;

means for shifting the phase of said second conditioned signal to produce a fourth output signal 90 degrees out of phase with said first output signal

42. A circuit for decoding two channel stereo signals into multi-channel sound signals comprising:

means for differencing left and right channel stereo signals to provide a primary signal;

means for dividing said primary signal into high, mid and low frequency band signals;

means for determining a dominant one of the two channel stereo signals;

means for separately dynamically varying the level of each of said band signals in response to the dominant of said left and right channel stereo signals to provide right and left varied signals in each said band;

means for combining said right high, mid and low frequency varied band signals to produce a first output signal; and means for combining said left high, mid and low frequency varied band signals to produce a second output signal.

43. A circuit according to claim 42 further comprising means for controlling the gain of said varying means to independently increase the level of each of said right dynamically varied signals when the level of a corresponding component of said right channel signal is high and to independently decrease the level of said right dynamically varied signals when the level of a corresponding component of said left channel signal is high and for controlling the gain of said varying means to independently increase the level of each of said left dynamically varied signals when the level of a corresponding component of said left channel signal is high and to independently decrease the level of said left dynamically varied signals when the level of a corresponding component of said right channel signal is high.

44. A circuit according to claim 42, said dividing means comprising:

means for filtering said primary signal to provide a high frequency band signal;

means for filtering said primary signal to provide a mid frequency band signal; and means for filtering said primary signal to provide a low frequency band signal.

45. A circuit according to claim 43, said controlling means comprising:

means for deriving first high, mid and low band dc signals proportional to said corresponding components of said right channel stereo signal;

means for deriving second high, mid and low band dc signals proportional to said corresponding components of said left channel stereo signal;

means for differencing said first and second high, first and second mid and first and second low band dc signals to provide high, mid and low band dc control signals which are positive when their respective said corresponding component of said left channel stereo signal is dominant and which are negative when their respective said corresponding component of said right channel stereo signal is dominant; and means for impressing positive and negative gains on said right and left high, mid and low band varying means in response to said positive and negative conditions of their respective said high, mid and low band dc control signals.

46. A circuit according to claim 42 further comprising means for enhancing said primary signal before said primary signal is divided into said high, mid and low frequency bands.

47. A circuit according to claim 46, said enhancing means comprising means for providing fixed localization equalization simulating the frequency response characteristics of the human ear.

48. A circuit according to claim 42 further comprising means for combining said left and right channel stereo signals into a summed signal.

49. A circuit according to claim 48 further comprising means for low pass filtering said summed signal to derive a low frequency signal, said second combining means further combining said low frequency signal with said left high, mid and low frequency varied band signals to produce said second output signal.

50. A circuit according to claim 49 further comprising means for differencing said first output signal and said low frequency signal to produce a phase coherent second output signal.

51. A circuit according to claim 48 further comprising:

means for high pass filtering said summed signal to derive a high frequency signal;

means for combining said high frequency signal with said left channel signal to produce a third output signal; and means for combining said high frequency signal with said right channel signal to produce a fourth output signal.

52. A circuit according to claim 43, said means for deriving first high, mid and low dc signals comprising:

means for high, mid and low pass filtering said right channel stereo signal to provide first high, mid and low filtered signals; and means for independently level sensing each of said first filtered signals; said means for deriving second high, mid and low dc signals comprising:

means for high, mid and low pass filtering said left channel stereo signals to provide second high, mid and low filtered signals; and means for independently level sensing each of said second filtered signals.

53. A circuit according to claim 52, each of said level sensing means comprising means for deriving a signal proportional to the log of the absolute value of its respective said first and second high, mid and low filtered signals.

54. A circuit according to claim 52, each of said level sensing means having means for maintaining the time constant of its respective first and second dc signals at a relatively fast rate.

55. A method for decoding two channel stereo signals into multi-channel sound signals comprising the steps of:

differencing the two channel stereo signals to provide a primary signal;

dividing said primary signal into a plurality of bands to provide a plurality of split frequency band signals; and determining a dominant one of the two channel stereo signals;

dynamically varying the level of at least one of said split band signals in response to the dominant of the two channel stereo signals to produce an audio output signal.

56. A method for decoding two channel stereo signals into multi-channel sound signals comprising:

differencing the two channel stereo signals to provide a primary signal;

dividing said primary signal into a plurality of bands to provide a plurality of split frequency band signals;

dynamically varying the level of at least one of said split frequency band signals to produce a first dynamically varied signal; and controlling the gain of said varying means to increase the level of said first dynamically varied signal when the level of one of the two channel signals is high and to decrease the level of said first dynamically varied signal when the level of the other of the two channel signals is high.

57. A method according to claim 56, said step of dividing comprising the substeps of:

filtering said primary signal to provide a high and mid frequency band signal; and filtering said primary signal to provide a low frequency band signal.

58. A method according to claim 56, said step of controlling comprising the substeps of:

deriving a first dc signal proportional to one of the two channel stereo signals;

deriving a second dc signal proportional to the other of the two channel stereo signals;

differencing said first and second dc signals to provide a dc control signal which is positive when one of the two channel stereo signals is dominant and which is negative when the other of the two channel stereo signals is dominant; and impressing positive and negative gains on said varying step in response to said positive and negative conditions of said dc control signal.

59. A method according to claim 56 further comprising the steps of:

dynamically varying the level of said at least one of said plurality of split frequency band signals to produce a second dynamically varied signal; and controlling the gain of said second varying means to increase the level of said second dynamically varied signal when the level of the other of the two channel signals is high and to decrease the level of said second dynamically varied signal when the level of the one of the two channel signals is high.

60. A method according to claim 55 further comprising the step of enhancing said primary signal before dividing said primary signal into said plurality of bands.

61. A method according to claim 60, said step of enhancing comprising the step of providing fixed localization equalization simulating the frequency response characteristics of the human ear.

62. A method according to claim 59 further comprising the step of combining another of said split frequency band signals with said first dynamically varied signal to produce a composite signal.

63. A method according to claim 59 further comprising the step of deriving low frequency response components of said two channel stereo signals.

64. A method according to claim 63 further comprising the step of adding said low frequency response components of said two channel stereo signals to said second dynamically varied signal.

65. A method according to claim 64, said step of adding comprising the substeps of:

combining the two channel stereo signals into a summed signal;

filtering said summed signal to derive a low frequency signal; and combining said low frequency signal with said second dynamically varied signal.

66. A method according to claim 64, said step of adding comprising the substeps of:

combining the two channel stereo signals into a summed signal;

filtering said summed signal to derive a low frequency signal; and combining said low frequency signal with said second dynamically varied signal and another of said split frequency band signals to produce a first output signal.

67. A method according to claim 63 further comprising the step of combining another of said split frequency band signals with said first dynamically varied signal to produce a composite signal.

68. A method according to claim 67 further comprising the step of differencing said composite signal and said low frequency response components to produce a phase coherent second output signal.

69. A method according to claim 62 further comprising the steps of:

combining the two channel stereo signals into a summed signal;

filtering said summed signal to derive a low frequency signal; and combining said low frequency signal with said second dynamically varied signal and another of said split frequency band signals to produce a first output signal.

70. A method according to claim 69 further comprising the step of differencing said composite signal and said low frequency signal to produce a phase coherent second output signal.

71. A method according to claim 59, said step of controlling comprising the substeps of:

deriving a first dc signal proportional to one of the two channel stereo signals;

deriving a second dc signal proportional to the other of the two channel stereo signals;

differencing said first and second dc signals to provide a dc control signal which is positive when one of the two channel stereo signals is dominant and which is negative when the other of the two channel stereo signals is dominant; and impressing positive gains on said first varying means and negative gains on said second varying means when said dc control signal is positive and for impressing positive gains on said second varying means and negative gains on said first varying means when said dc control signal is negative.

72. A method according to claim 58, said step of deriving a first dc signal comprising the substeps of:

high pass filtering said one of the two channel stereo signals to provide a first filtered signal; and level sensing said first filtered signal; said step of deriving a second dc signal comprising the substeps of:

high pass filtering said other of the two channel stereo signals to provide a second filtered signal; and level sensing said second filtered signal.

73. A method according to claim 72, each of said steps of level sensing comprising the step of deriving a signal proportional to the log of the absolute value of its respective said first and second filtered signals.

74. A method according to claim 72, each of said steps of level sensing further comprising the substep of maintaining the time constant of its respective first and second dc signals at a relatively fast rate.

75. A method according to claim 59 further comprising the steps of:

deriving a first dc signal proportional to one of the two channel stereo signals;

deriving a second dc signal proportional to the other of the two channel stereo signals;

differencing said first and second dc signals to provide a dc control signal which is positive when one of the two channel stereo signals is dominant and which is negative when the other of the two channel stereo signals is dominant; and controlling the gain of said first dynamically varying means to increase the level of said first dynamically varied signal when the level of said one of the two channel signals is high and to decrease the level of said first dynamically varied signal when the level of the other of the two channel signals is high and controlling the gain of said second dynamically varying means to increase the level of said second dynamically varied signal when the level of said other of the two channel signals is high and to decrease the level of said second dynamically varied signal when the level of the one of the two channel signals is high.

76. A method according to claim 75, said step of deriving a first dc signal comprising the steps of:

high pass filtering said one of the two channel stereo signals to provide a first filtered signal; and level sensing said first filtered signal; said step of deriving a second dc signal comprising:

high pass filtering said other of the two channel stereo signals to provide a second filtered signal; and level sensing said second filtered signal.

77. A method according to claim 76 further comprising the steps of:

sensing the level of said at least one of said split band signals; and providing a dc voltage to each of said first and second level sensing means which increases in response to a decrease in level beneath a threshold level of said at least one of said split band signals.

78. A method for decoding two channel stereo signals into multi-channel sound signals comprising the steps of:

differencing the two channel stereo signals to provide a primary signal;

dividing said primary signal into a plurality of bands to provide a plurality of split frequency band signals;

dynamically varying the level of one of said split frequency band signals to provide a first dynamically varied signal;

dynamically varying the level of another of said split frequency band signals to produce a second dynamically varied signal;

deriving a first dc signal proportional to one of the two channel stereo signals;

deriving a second dc signal proportional to the other of the two channel stereo signals;

differencing said first and second dc signals to provide a dc control signal which is positive when one of the two channel stereo signals is dominant and which is negative when the other of the two channel stereo signals is dominant; and controlling the gain of said one varying step to increase the level of said first varied signal when the level of said one of the two channel signals is high and to decrease the level of said second varied signal when the level of said one of the two channel signals is high and controlling the gain of said another varying step to increase the level of said second varied signal when the level of said other of the two channel signals is high and to decrease the level of said first varied signal when the level of said other of the two channel signals is high.

79. A method according to claim 78, said step of controlling comprising the substeps of:

inverting said dc control signal to provide an opposite polarity dc control signal which is negative when said one of the two channel stereo signals is dominant and which is positive when said other of the two channel stereo signals is dominant;

rectifying said dc control signal to provide a first positive voltage when said one of said two channel stereo signals is dominant;

applying said first positive voltage to control said another varying step;

rectifying said opposite polarity dc control signal to provide a second positive voltage when said other of said two channel stereo signals is dominant; and applying said second positive voltage to control said one varying step.

80. A method according to claim 79, said step of controlling further comprising the steps of:

limiting said first positive voltage applied to said one control step to a maximum level; and limiting said second positive voltage applied to said other control step to a maximum level.

81. A method according to claim 80, said step of controlling further comprising the steps of:
inverting said first positive voltage;
cross coupling said inverted first positive voltage with said limited second positive voltage;
inverting said second positive voltage; and
cross coupling said inverted second positive voltage with said limited first positive voltage.

82. A method according to claim 81, said step of deriving a first dc signal comprising the substeps of:
high pass filtering said one of the two channel stereo signals to provide a first filtered signal; and
level sensing said first filtered signal; said step of deriving a second dc signal comprising the substeps of:
high pass filtering said other of the two channel stereo signals to provide a second filtered signal; and
level sensing said second filtered signal.

83. A method according to claim 82, each of said steps of level sensing comprising the step of deriving a signal proportional to the log of the absolute value of its respective said first and second filtered signals.

84. A method according to claim 82, each of said steps of level sensing further comprising the substep of maintaining the time constant of its respective first and second dc signals at a relatively fast rate.

85. A method according to claim 84, said step of controlling further comprising the substeps of maintaining the time constants of said first and second positive voltages, respectively, at a rate at least twice as fast as said relatively fast rate.

86. A method according to claim 78 further comprising the steps of:
combining the two channel stereo signals into a summed signal;
filtering said summed signal to derive a low frequency signal;
combining said low frequency signal with said second dynamically varied signal and another of said split frequency band signals to produce a first output signal; and
combining another of said split frequency band signals with said first dynamically varied signal to produce a composite signal.

87. A method according to claim 86 further comprising the step of differencing said composite signal and said low frequency response components to produce a second output signal.

88. A method according to claim 78 further comprising the step of shifting the phase of said primary signal to provide a phase-shifted signal to said dividing step.

89. A method according to claim 88 further comprising the steps of:
combining the two channel stereo signals;
deriving low frequency response components of said combined two channel stereo signals;
combining said low frequency response components with said second dynamically varied signal and another of said split frequency band signals to produce a first output signal; and
combining said low frequency response components with said first dynamically varied signal and another of said split frequency band signals to produce a second output signal.

90. A method according to claim 89 further comprising the steps of:
high pass filtering said combined two channel stereo signals to produce a base signal;
combining said base signal with said one of said two channel stereo signals to produce a first conditioned signal;
shifting the phase of said first conditioned signal to produce a third output signal 90 degrees out of phase with said second output signal;
combining said base signal with said other of said two channel stereo signals to produce a second conditioned signal;
shifting the phase of said second conditioned signal to produce a fourth output signal 90 degrees out of phase with said first output signal.

91. A method for decoding two channel stereo signals into multi-channel sound signals comprising the steps of:
differencing the two channel stereo signals to provide a primary signal;
shifting the phase of said primary signal to provide a phase-shifted signal;
dynamically varying the level of said phase-shifted signal to provide a first dynamically varied signal;
dynamically varying the level of said phase-shifted signal to produce a second dynamically varied signal;
deriving a first dc signal proportional to one of the two channel stereo signals;
deriving a second dc signal proportional to the other of the two channel stereo signals;
differencing said first and second dc signals to provide a dc control signal which is positive when one of the two channel stereo signals is dominant and which is negative when the other of the two channel stereo signals is dominant; and
controlling the gain of said first varying step to increase the level of said first varied signal when the level of said one of the two channel signals is high and to decrease the level of said second varied signal when the level of said one of the two channel signals is high and controlling the gain of said second varying step to increase the level of said second varied signal when the level of said other of the two channel signals is high and to decrease the level of said first varied signal when the level of said other of the two channel signals is high.

92. A method according to claim 91 further comprising the steps of:
combining the two channel stereo signals;
deriving low frequency response components of said combined two channel stereo signals;
combining said low frequency response components with said second dynamically varied signal to produce a first output signal; and
combining said low frequency response components with said first dynamically varied signal to produce a second output signal.

93. A method according to claim 92 further comprising the steps of:
high pass filtering said combined two channel stereo signals to produce a base signal;
combining said base signal with said one of said two channel stereo signals to produce a first conditioned signal;
shifting the phase of said first conditioned signal to produce a third output signal 90 degrees out of phase with said second output signal;
combining said base signal with said other of said two channel stereo signals to produce a second conditioned signal;

shifting the phase of said second conditioned signal to produce a fourth output signal 90 degrees out of phase with said first output signal;

94. A method for decoding two channel stereo signals into multi-channel sound signals comprising the steps of:

differencing the two channel stereo signals to provide a primary signal;

shifting the phase of said primary signal to provide a phase-shifted signal;

dynamically varying the level of said phase-shifted signal to provide a first dynamically varied signal;

dynamically varying the level of said phase-shifted signal to produce a second dynamically varied signal;

deriving a first dc signal proportional to one of the two channel stereo signals;

deriving a second dc signal proportional to the other of the two channel stereo signals;

differencing said first and second dc signals to provide a dc control signal which is positive when one of the two channel stereo signals is dominant and which is negative when the other of the two channel stereo signals is dominant;

controlling the gain of said first varying step to increase the level of said first varied signal when the level of said one of the two channel signals is high and to decrease the level of said second varied signal when the level of said one of the two channel signals is high and controlling the gain of said second varying step to increase the level of said second varied signal when the level of said other of the two channel signals is high and to decrease the level of said first varied signal when the level of said other of the two channel signals is high;

deriving low frequency response components of said one of said two channel stereo signals;

combining said low frequency response components of said one of said two channel stereo signals with said second dynamically varied signal to produce a first output signal;

deriving low frequency response components of said other of said two channel stereo signals; and combining said low frequency response components of said other of said two channel stereo signals with said first dynamically varied signal to produce a first output signal.

95. A method according to claim 94 further comprising the steps of:

combining the two channel stereo signals;

high pass filtering said combined two channel stereo signals to produce a base signal;

combining said base signal with said one of said two channel stereo signals to produce a first conditioned signal;

shifting the phase of said first conditioned signal to produce a third output signal 90 degrees out of phase with said second output signal;

combining said base signal with said other of said two channel stereo signals to produce a second conditioned signal;

shifting the phase of said second conditioned signal to produce a fourth output signal 90 degrees out of phase with said first output signal.

96. A method for decoding two channel stereo signals into multi-channel sound signals comprising the steps of:

differencing left and right channel stereo signals to provide a primary signal;

dividing said primary signal into high, mid and low frequency band signals;

determining a dominant one of the two channel stereo signals;

separately dynamically varying the level of each of said band signals in response to the dominant of said left and right channel stereo signals to provide right and left varied signals in each said band;

combining said right high, mid and low frequency varied band signals to produce a first output signal; and combining said left high, mid and low frequency varied band signals to produce a second output signal.

97. A method according to claim 96 further comprising the step of controlling the gain of said varying means to independently increase the level of each of said right dynamically varied signals when the level of a corresponding component of said right channel signal is high and to independently decrease the level of said right dynamically varied signals when the level of a corresponding component of said left channel signal is high and controlling the gain of said varying means to independently increase the level of each of said left dynamically varied signals when the level of a corresponding component of said left channel signal is high and to independently decrease the level of said left dynamically varied signals when the level of a corresponding component of said right channel signal is high.

98. A method according to claim 96, said step of dividing comprising the substeps of:

filtering said primary signal to provide a high frequency band signal;

filtering said primary signal to provide a mid frequency band signal; and filtering said primary signal to provide a low frequency band signal.

99. A method according to claim 97, said step of controlling comprising the substeps of:

deriving first high, mid and low band dc signals proportional to said corresponding components of said right channel stereo signal;

deriving second high, mid and low band dc signals proportional to said corresponding components of said left channel stereo signal;

differencing said first and second high, first and second mid and first and second low band dc signals to provide high, mid and low band dc control signals which are positive when their respective said corresponding component of said left channel stereo signal is dominant and which are negative when their respective said corresponding component of said right channel stereo signal is dominant; and impressing positive and negative gains on said right and left high, mid and low band varying steps in response to said positive and negative conditions of their respective said high, mid and low band dc control signals.

100. A method according to claim 96 further comprising the step of enhancing said primary signal before said primary signal is divided into said high, mid and low frequency bands.

101. A method according to claim 100, said step of enhancing comprising the step of providing fixed localization equalization simulating the frequency response characteristics of the human ear.

102. A method according to claim 96 further comprising the step of combining said left and right channel stereo signals into a summed signal.

103. A method according to claim 102 further comprising the step of low pass filtering said summed signal to derive a low frequency signal, said second combining step further combining said low frequency signal with said left high, mid and low frequency varied band signals to produce said second output signal.

104. A method according to claim 103 further comprising the step of differencing said first output signal and said low frequency signal to produce a phase coherent second output signal.

105. A method according to claim 102 further comprising the steps of:

high pass filtering said summed signal to derive a high frequency signal;

combining said high frequency signal with said left channel signal to produce a third output signal; and combining said high frequency signal with said right channel signal to produce a fourth output signal.

106. A method according to claim 97, said step of deriving first high, mid and low dc signals comprising the substeps of:

high, mid and low pass filtering said right channel stereo signal to provide first high, mid and low filtered signals; and independently level sensing each of said first filtered signals; said step of deriving second high, mid and low dc signals comprising the substeps of:

high, mid and low pass filtering said left channel stereo signals to provide second high, mid and low filtered signals; and independently level sensing each of said second filtered signals.

107. A method according to claim 106, each of said level sensing steps comprising the step of deriving a signal proportional to the log of the absolute value of its respective said first and second high, mid and low filtered signals.

108. A method according to claim 106, each of said level sensing steps further comprising the substep of maintaining the time constant of its respective first and second dc signals at a relatively fast rate.

* * * * *